US005342505A

United States Patent [19]

Forester

[11] Patent Number: 5,342,505

[45] Date of Patent: Aug. 30, 1994

[54] USE OF POLYALKENYL SUCCINIMIDES-GLYCIDOL REACTION PRODUCTS AS ANTIFOULANTS IN HYDROCARBON PROCESS MEDIA

[75] Inventor: David R. Forester, Conroe, Tex.

[73] Assignee: Betz Laboratories, Inc., Trevose, Pa.

[21] Appl. No.: 24,115

[22] Filed: Feb. 25, 1993

[51] Int. Cl.[5] ..... C10G 9/16

[52] U.S. Cl. ..... 208/48 AA; 208/48 R; 585/950

[58] Field of Search ..... 208/48 AA, 48 R; 585/950; 203/8, 9

[56] References Cited

U.S. PATENT DOCUMENTS

| | | | |
|---|---|---|---|
| 3,235,484 | 2/1966 | Colfer | 208/48 |
| 3,373,111 | 3/1968 | LeSuer et al. | 252/51.5 A |
| 4,578,178 | 3/1986 | Forester | 208/48 AA |
| 4,617,137 | 10/1986 | Plavac | 252/49.6 |
| 4,631,070 | 12/1986 | Plavac | 44/63 |
| 4,883,886 | 11/1989 | Huang | 549/255 |
| 4,954,572 | 9/1990 | Emert et al. | 525/285 |

FOREIGN PATENT DOCUMENTS

| | | | |
|---|---|---|---|
| 1172492 | 7/1989 | Japan | 208/48 AA |

*Primary Examiner*—Helane Myers
*Assistant Examiner*—Walter D. Griffin
*Attorney, Agent, or Firm*—Alexander D. Ricci; Richard A. Paikoff

[57] ABSTRACT

Reaction products of polyalkenyl succinimides with an epoxy alkanol are used as effective antifoulants in liquid hydrocarbonaceous mediums, such as crude oils and gas oils, during processing of such liquids at elevated temperatures. The reaction products are formed via a two-step reaction in which a polyalkenyl succinic anhydride precursor is reacted with an alkenylpolyamine to form a polyalkenyl succinimide intermediate which, in turn, is reacted with an epoxy alkanol.

11 Claims, No Drawings

USE OF POLYALKENYL SUCCINIMIDES-GLYCIDOL REACTION PRODUCTS AS ANTIFOULANTS IN HYDROCARBON PROCESS MEDIA

FIELD OF THE INVENTION

The present invention pertains to the use of the reaction products of polyalkenyl succinimides with glycidol to inhibit fouling in liquid hydrocarbon mediums during the heat treatment processing of the medium, such as in refinery processes.

BACKGROUND OF THE INVENTION

In the processing of petroleum hydrocarbons and feed stocks, such as petroleum processing intermediates, and petrochemicals and petrochemical intermediates, e.g., gas, oils and reformer stocks, chlorinated hydrocarbons and olefin plant fluids, such as deethanizer bottoms, the hydrocarbons are commonly heated to temperatures of 40° to 550° C., frequently from 200°–550° C. Similarly, such petroleum hydrocarbons are frequently employed as heating mediums on the "hot side" of heating and heating exchange systems. In virtually every case, these petroleum hydrocarbons contain deposit-forming compounds or constituents that are present before the processing is carried out. Examples of these preexisting deposit-forming materials are alkali and alkaline earth metal-containing compounds, e.g., sodium chloride; transition metal compounds or complexes, such as porphyrins or iron sulfide; sulfur-containing compounds, such as mercaptans; nitrogen-containing compounds, such as pyrroles, carbonyl or carboxylic acid-containing compounds; poly-nuclear aromatics, such as asphaltenes; and/or coke particles. These deposit-forming compounds can combine or react during elevated temperature processing to produce a separate phase known as fouling deposits, within the petroleum hydrocarbon.

In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shut-downs for cleaning. Moreover, these deposits reduce throughput, which of course results in a loss of capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities present therein and/or salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel or carbon black.

SUMMARY OF THE INVENTION

In accordance with the invention, the reaction products of polyalkenyl succinimides with glycidol are used to inhibit fouling of heated liquid hydrocarbon mediums. Typically, such antifoulant protection is provided during heat processing of the medium, such as in refinery, purification, or production processes.

The reaction products of the type used herein have been disclosed in U.S. Pat. No. 4,617,137 as dispersant additives for use in lubricating oils, hydraulic fluids, marine crank case lubricants and fuels. The stated purpose of the additives disclosed in the '137 patent is to help reduce engine deposits, particularly with respect to sludge and varnish deposits, and to improve the stability and cleanliness of lube oil compositions. The stability of lubricating oil with an additive of the reaction product disclosed in the '137 patent was shown to be improved when evaluated in a Sequence VD Test Method (ASTM) that simulates severe field service characterized by low speed, low temperature "stop and go" city driving and moderate turnpike operation.

DETAILED DESCRIPTION OF THE INVENTION

I have found that the reaction products of polyalkenylsuccinimides with glycidol provide significant antifoulant efficacy in liquid hydrocarbonaceous mediums during the high temperature treatment of the medium.

It is to be understood that the phrase "liquid hydrocarbonaceous medium" as used herein signifies various and sundry petroleum hydrocarbons and petrochemicals. For instance, petroleum hydrocarbons such as petroleum hydrocarbon feedstocks including crude oils and fractions thereof such as naphtha, gasoline, kerosene, diesel, jet fuel, gas oil, vacuum residua, etc., are all included in the definition.

Similarly, petrochemicals such as olefinic or naphthenic process streams, aromatic hydrocarbons and their derivatives, ethylene dichloride, and ethylene glycol are all considered to be within the ambit of the phrase "liquid hydrocarbonaceous mediums ".

The reaction products of polyalkenyl succinimides with glycidol useful in the invention are generally prepared via a two-step reaction. In the first step, a polyalkenyl succinic anhydride is reacted with a polyamine, preferably an ethylenepolyamine, to form the desired polyalkenyl succinimide. Then, the polyalkenyl succinimide is reacted with an epoxy alkanol, e.g., glycidol or phenyl glycidol in an organic solvent medium to form the desired reaction product.

More specifically, the starting reactant, polyalkenylsuccinic anhydride may be purchased commercially or prepared. Presently, it is preferred to buy this from Texaco. One such commercially sold polyalkenylsuccinic anhydride is sold under the trademark TLA-627. It is a polyisobutenylsuccinic anhydride (PIBSA) having the structure

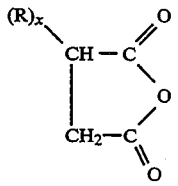

(I)

wherein, in this case, R is an isobutenyl repeat unit. The average molecular weight of the polyisobutene used to produce the PIBSA is about 1300.

The precursor polyalkenylsuccinic anhydride may also be prepared as reported in U.S. Pat. No. 3,235,484 (Colfer), incorporated herein by reference or by the methods reported in U.S. Pat. No. 4,883,886 (Huang), also incorporated by reference herein. As to the Colfer method, the anhydrides may be prepared by reaction of maleic anhydride with a high molecular weight olefin or a chlorinated high molecular weight olefin. In the Huang method, reaction of a polymer of a $C_2$–$C_8$ olefin and maleic anhydride are carried out in the presence of a tar and side product suppressing agent.

The most commonly used sources for forming the aliphatic R substituent on the succinic anhydride compound (I) are the polyolefins, such as polyethylene, polypropylene, polyisobutene, polyamylene, polyisohexylene, etc. The most particularly preferred polyolefin (and the one used to manufacture the polyisobutenylsuccinic anhydride from Texaco) is polyisobutene. As Colfer states, particular preference is made for such a polyisobutene-containing at least about 50 carbon atoms, preferably from at least 60 carbon atoms and most desirably from about 100 to about 150 carbon atoms. Accordingly, an operable carbon atom number range for R is from about 30–200 carbon atoms.

Once the polyalkenylsuccinic anhydride precursor is obtained, it is reacted with a polyamine, as reported in Colfer, at temperature in excess of about 80° C. so as to form an imide. More specifically, the polyalkenylsuccinic anhydride

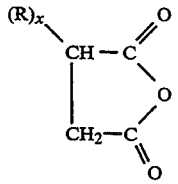

(I)

wherein R is an aliphatic alkenyl or alkyl moiety having at least about 50 carbon atoms and less than about 200 carbon atoms, is reacted with a polyamine having the structure

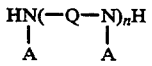

(II)

in which n is an integer, A is chosen from hydrocarbyl, hydroxy-alkyl or hydrogen with the proviso that at least one A is hydrogen. Q signifies a divalent aliphatic radical. As Colfer indicates, the A substituents can be considered as forming a divalent alkylene radical, thus resulting in a cyclic structure. Q generally, however, is ($C_1$–$C_5$) alkylene, such as ethylene, trimethylene, tetramethylene, etc. Q is most preferably ethylene.

Accordingly, exemplary amine components may comprise ethylenediamine, triethylenetetramine, tetraethylenepentamine, diethylenetriamine, trimethylenediamine, bis(trimethylene)triamine, tris-(trimethylene)tetramine, tris(hexamethylene)tetramine, decamethylenediamine, N-octyltrimethylene diamine, N-(2-hydroxyethyl)ethylenediamine, 1-(2-aminopropyl)piperazine, 1,4-bis(2-aminoethyl)piperazine, bis-(hydroxypropyl)substituted tetraethylenepentamine, N-3-(hydroxypropyl)tetramethylenediamine, 2-methylimidazoline, polymerized ethyleneamine, and 1,3-bis (2-aminoethyl)imidazoline.

The reaction of precursor polyalkenylsuccinic anhydride with amine (II) is conducted at temperature in excess of 80° C. with use of a solvent, such as benzene, xylene, toluene, naphtha, mineral oil, n-hexane, etc. Preferably, the reaction is conducted at from 100°–250° C. with the molar amount of precursor anhydride (I): amine (II) being from about 1:5 to about 5:1 with a molar amount of 1–3:1 being preferred.

The polyalkenylsuccinimide so obtained will have the structure

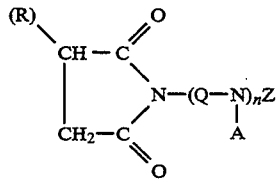

(III)

wherein R, Q, A and n are as previously defined in connection with structural formulae I and II. Z is either H or

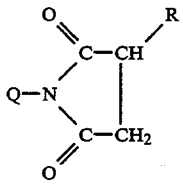

(IV)

Glycidol is a commercially available reagent of the formula:

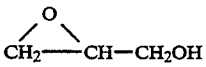

(V)

Also, glycidol may be prepared from glycerol-1-monochlorohydrin by the action of potassium hydroxide in alcohol.

After the polyalkenyl succinimide precursor has been obtained, it is reacted with glycidol as reported in U.S. Pat. No. 4,617,137 to form the desired reaction product.

At present, preliminary studies have indicated surprisingly effective antifouling inhibition results with these reaction products. The polyisobutenyl succinimide is formed from about a 2:1 molar ratio of polyisobutenyl succinic anhydride (MW isobutenyl moiety 1300) with an ethylenepolyamine, in this case triethylenetetramine.

The polyalkenyl-substituted succinimide and glycidol are reacted in a mole ratio of succinimide to glycidol respectively of between about 1 to 0.1 and 1 to 4, preferably at a temperature of about 100° C. to 200° C. at ambient pressure. If desired, the reaction can be conducted in a carrier solvent such as xylene or toluene and in a non-reactive atmosphere. After reaction is complete, the reaction mass is treated to remove any solvent. The resulting product is the desired additive product.

The reaction products useful in the invention may be added to or dispersed within the liquid hydrocarbonaceous medium in need of antifouling protection in an amount of 0.5–10,000 ppm based upon one million parts of the liquid hydrocarbonaceous medium. Preferably, the antifoulant is added in an amount of from 1 to 2500 ppm.

The reaction products may be dissolved in a polar or non-polar organic solvent, such as heavy aromatic naphtha, toluene, xylene, or mineral oil and fed to the requisite hot process fluid or they can be fed neat thereto. These products are especially effective when added to the liquid hydrocarbonaceous medium during the heat processing thereof at temperatures of from 200°–550° C.

Example 1

To a 1000 mL resin kettle equipped with overhead stirring, thermometer, an addition funnel, and a condenser, were charged 65% PIBSA (385 g, polyisobutenylsuccinic anhydride, MW 1300, 193 mmol), Mentor ®28 hydrocarbon solvent (130 g), and xylenes (16 ml). The mixture was heated to 60° C. to facilitate mixing, and triethylenetetramine (14 g, 96 mmol) was added over 10 minutes via the addition funnel. The mixture was heated at reflux (132° C.) for 3 hours. The condenser was fitted with a Dean-Stark trap that was filled with xylene. The refluxing was continued until water stopped collecting in the trap. The remaining xylenes were removed by vacuum distillation (22° C., 71 torr), resulting in a viscous brown oil (525 g).

Example 2

To a 100 ml resin kettle equipped with overhead stirring, a thermometer, a condenser and a nitrogen inlet was charged 100 g of example 1 (18 mmole). Glycidol (1.9 g, 26 mmole) was added over 1.0 hour via syringe. The mixture was then heated to 150° C. for 5 hours resulting in a viscous brown oil (101.9 g).

Antifoulant Tests

The dual fouling apparatus (DFA), as described in U.S. Pat. NO. 4,578,178, was used to determine the antifoulant efficacy of a polyisobutenyl succinimide reacted with glycidol (Example 2) in crude oil, as illustrated in Table 1. The antifoulant efficacy of a polyisobutenyl succinimide antifoulant, sold commercially as a dispersant additive for automotive lubricating oils, was compared to this compound in crude oil with results detailed in Table 1. Also, the PIBSA succinimide prepared in Example 1 was compared for antifoulant efficacy.

The DFA used to generate the data shown in Table I contains two independent, heated rod exchangers. In the DFA tests, rod temperature was controlled while testing. As fouling on the rod occurs, less heat is transferred to the fluid so that the process fluid outlet temperature decreases. Antifoulant protection was determined by comparing the summed areas between the heat transfer curves for control and treated runs and the ideal case for each run. In this method, the temperatures of the oil inlet and outlet and rod temperatures at the oil inlet (cold end) and outlet (hot end) are used to calculate U-rig coefficients of heat transfer every 2 minutes during the tests. From these U-rig coefficients, areas under the fouling curves are calculated and subtracted from the non-fouling curve for each run. Comparing the areas of control runs (averaged) and treated runs in the following equation results in a percent protection value for antifoulants.

$$\% \text{ Protection} = \frac{\text{Avg. } \Delta \text{ Area (control)} - \Delta \text{ Area (Treatment)}}{\text{Avg. } \Delta \text{ Area (control)}} \times 100$$

TABLE I

Summary of DFA Results on Glycidol Modified PIB Succinimide Compared to Polyisobutenyl Antifoulant (PIBSA Succinimide) Desalted Crude Oil, 482° C. Rod Temperature

| Additive (ppm active) | | % Protection |
|---|---|---|
| PIBSA Succinimide | (62.5) | 8 (Avg) |
| | (125) | 9 |
| | (250) | 18 |
| Example 2 | (62.5) | 21 |
| | (125) | 16 |
| | (250) | 26 |
| Example 1 | (62.5) | 25 |
| | (125) | 6 |
| | (250) | 17 |

As shown in Table 1 , the antifoulant efficacy of Example 2 was higher than that of the commercial PIBSA succinimide when tested at dosages of 62.5, 125 or 250 ppm active.

Another series of tests adapted to assess candidate efficacy in providing fouling inhibition during low to moderate temperature treatment of liquid hydrocarbon medium were performed. These tests are entitled the "Hot Filament Fouling Tests" and were run in conjunction with gas oil hydrocarbon medium. The procedure for these tests involves the following:

A preweighed 24-gauge Ni-chrome wire was placed between two brass electrodes in a glass reaction jar and held in place by two brass screws. 200 mLs of feedstock were measured and added into each sample jar. One sample jar was left untreated as a control with other jars being supplied with 125 ppm (active) of the candidate material. The brass electrode assembly and lids were placed on each jar and tightly secured. The treatments were mixed via swirling the feedstock. Four sample jars were connected in series with a controller provided for each series of jars.

The controllers were turned on and provided 8 amps of current to each jar. This amperage provided a temperature of about 125°–150° C. within each sample jar. After 24 hours of current flow, the controllers were turned off and the jars were disconnected from their series connection. The wires, which were immersed in the hot medium during the testing, were carefully removed from their jars, were washed with xylene and acetone, and were allowed to dry.

Each wire and the resulting deposits thereon were weighed with the weight of the deposit being calculated.

The deposit weight for a given wire was calculated in accordance with $$\text{wt. deposit} = \left(\begin{matrix}\text{weight of wire}\\ \text{plus deposit}\end{matrix}\right) - (\text{original wire weight})$$

The percentage protection for each treatment sample was then calculated as follows:

$$\%\ \text{protection} = \left[1 - \frac{\text{wt. deposit(treated)}}{\text{wt. deposit(untreated)}}\right] \times 100$$

Results are shown in Table II.

TABLE II

| Additive | ppm Actives | Feedstock Type | % Protection |
|---|---|---|---|
| PIBSA Succinimide | 125 | SRLGO | 40 (avg) |
| | 125 | CCLGO | 89 (avg) |
| Example 1 | 125 | SRLGO | 64 |
| | 125 | CCLGO | 65 |
| Example 2 | 125 | SRLGO | 47 |
| | 125 | CCLGO | 50 |

In Table II, SRLGO 1means straight run light gas oil from a midwestern refinery with CCLGO indicating a catalytic cracked light gas oil from the same midwestern refinery. When tested in the SRLGO, the succinimide of Example 1 and the reaction product of Example 2 were better than the commercially available PIBSA succinimide. When tested in the CCLGO, commercially available PIBSA succinimide provided better antifoulant efficacy. These results indicate that both of the succinimides and the reaction product of Example 2 would be expected to reduce fouling at temperatures below 150° C. However, most fouling problems in petroleum processing occur at temperatures of from about 200° C.–550° C.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

I claim:

1. A method of inhibiting fouling deposit formation in a liquid hydrocarbonaceous medium during heat treatment processing thereof at temperatures of about 200°–550° C., wherein, in the absence of such antifouling treatment, fouling deposits are normally formed as a separate phase within said liquid hydrocarbonaceous medium impeding process throughput and thermal transfer, said method comprising adding to said liquid hydrocarbonaceous medium, an antifouling amount of a reaction product of a polyalkenylsuccinimide having the formula

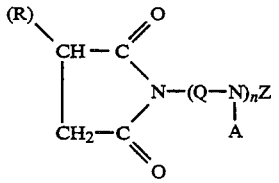

(III)

wherein R is an aliphatic alkyl or alkenyl moiety having at least about 50 carbon atoms and less than about 200 carbon atoms, Q i a divalent aliphatic radical, n is a positive integer, A is hydrocarbyl, hydroxyalkyl or hydrogen, Z is H or

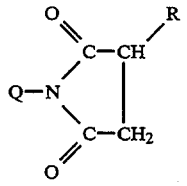

with glycidol, said liquid hydrocarbonaceous medium comprising petroleum hydrocarbons and petrochemicals.

2. The method as recited in claim 1 further comprising adding from about 0.5–10,000 parts by weight of said reaction product to said liquid hydrocarbonaceous medium based upon one million parts of said hydrocarbonaceous medium.

3. The method as recited in claim 1 wherein said liquid hydrocarbonaceous medium comprises crude oil, straight run gas oil, or catalytically cracked light gas oil.

4. The method as recited in claim 1 wherein R comprises from about 50–150 carbon atoms and is a polyalkenyl moiety.

5. The method as recited in claim 4 wherein R comprises a repeated isobutenyl moiety.

6. The method as recited in claim 5 wherein Q is chosen from $C_1$–$C_5$ alkylene and A is hydrogen.

7. The method as recited in claim 6 wherein Q is ethylene.

8. The method as recited in claim 4 wherein R has a molecular weight of about 1300.

9. A method for inhibiting fouling deposit formation in a liquid hydrocarbonaceous medium during heat treatment processing thereof at temperatures from about 200°–550° C., wherein, in the absence of such antifouling treatment, fouling deposits are normally formed as a separate phase within said liquid hydrocarbonaceous medium impeding process throughput and thermal transfer, said method comprising adding to said liquid hydrocarbonaceous medium, an antifouling amount of an antifoulant reaction product, said antifoulant reaction product formed by first reaction of polyalkenyl succinic anhydride with a polyamine to form a polyalkenyl succinimide intermediate, followed by a second stage reaction of said intermediate with glycidol to form said antifoulant reaction product, said liquid bydrocarbonaceous medium comprising petroleum hydrocarbons and petrochemicals.

10. The method as recited in claim 9 wherein said polyamine comprises an ethylenepolyamine.

11. The method as recited in claim 10 wherein said ethylenepolyamine comprises triethylenetetramine.

* * * * *